US005575704A

United States Patent [19]

Hotani

[11] Patent Number: 5,575,704

[45] Date of Patent: Nov. 19, 1996

[54] METHOD OF POLISHING METAL STRIPS

[75] Inventor: Setsuo Hotani, Wakayama-ken, Japan

[73] Assignee: Hotani Co., Ltd., Wakayama-ken, Japan

[21] Appl. No.: 369,929

[22] Filed: Jan. 6, 1995

[30] Foreign Application Priority Data

Jan. 7, 1994 [JP] Japan ..... 6-000439

[51] Int. Cl.[6] ..... B24B 1/00

[52] U.S. Cl. ..... 451/36; 451/59; 451/60; 451/466

[58] Field of Search ..... 451/28, 36, 59, 451/60, 65, 66, 67, 465, 466

[56] References Cited

U.S. PATENT DOCUMENTS

| | | | |
|---|---|---|---|
| 2,739,429 | 3/1956 | Peterson | 451/60 X |
| 3,629,979 | 12/1971 | Albers, Jr. et al. | 451/36 |
| 3,685,208 | 8/1972 | Richter . | |
| 3,882,648 | 5/1975 | Buchinski et al. . | |
| 4,203,257 | 5/1980 | Jamison et al. | 451/36 |
| 4,993,198 | 2/1991 | Hotani . | |
| 5,216,843 | 6/1993 | Breivogel et al. | 451/36 X |
| 5,235,959 | 8/1993 | Frank et al. | 451/36 X |

FOREIGN PATENT DOCUMENTS

| | | | |
|---|---|---|---|
| 0107514 | 5/1984 | European Pat. Off. . | |
| 0453321 | 10/1991 | European Pat. Off. . | |
| 2580974 | 10/1986 | France . | |
| 63-22948 | 5/1988 | Japan . | |
| 228563 | 10/1991 | Japan | 451/36 |
| 93/24717 | 12/1993 | WIPO . | |

OTHER PUBLICATIONS

Patent Abstracts of Japan, vol. 9, No. 25 (M–355) [1748], 2 Feb. 1985 & JP–A–59 169762 (Shiyouwa Denkou Kensou K.K.) * abstract *.

Patent Abstracts of Japan, vol. 17, No. 651 (M–1519), 3 Dec. 1993 & JP–A–52 012432 (Hotani:KK) * abstract *.

*Primary Examiner*—Timothy V. Eley

*Attorney, Agent, or Firm*—Larson and Taylor

[57] ABSTRACT

A method of polishing or grinding metal strips moving longitudinally thereof, the method comprising brushing or polishing the metal strip using a brush roll which is rotatable and is held, during rotation, in contact with the strip surface pressed by the brush roll while supplying a mixture of a grinding fluid or water with abrasive grains to a portion of strip surface to be brushed or polished, the brush roll having a plurality of abrasive members each comprising a plurality of rod-shaped elastic supports and a plurality of abrasive tips, the abrasive tips being formed from a mixture of abrasive grains and a resin and attached to the forward ends of the supports, and the plurality of abrasive members being mounted in clusters on a roll shaft, wherein the strip surface is brushed by the brush roll under a pressure of at least 1 kg/cm$^2$ and wherein the abrasive members have elasticity commensurate with stiffness which permits the ends of abrasive members to contact with the strip during brushing under the pressure, and the abrasive members have forward ends of at least 2 mm in diameter.

3 Claims, 7 Drawing Sheets

(A)

(B)

METHOD OF POLISHING METAL STRIPS

BACKGROUND OF THE INVENTION

1. Field of the Invention

The present invention relates to a method of polishing or grinding metal plates or metal strips such as steel plates or sheets, thin steel plates, etc. in making steel into a strip. The invention more particularly concerns with a method of polishing or grinding metal strips running longitudinally thereof in a process, the method comprising brushing or polishing the metal strip with a brush roll rotated in contact with the strip surface under a pressure while supplying a mixture of a grinding fluid or water with abrasive grains to a portion of metal strip to be brushed or polished.

2. Description of the Prior Art

Such methods of polishing metal strips are known. For example, the methods have been heretofore employed for polishing or grinding steel strips with good results in making steel into a strip. However, if a metal strip has pinholes, pits or the like, the methods can not polish the defective spots except by grinding the strip to the level of indent bottom. The grinding to the level of indent bottom decreases the productivity and increases the consumption of brush roll and the loss of metal material. Hence it raises the production cost and is undesirable. Further, some metal strips provided in making steel into a strip have these defects as is well known in the art.

SUMMARY OF THE INVENTION

An object of the present invention is to provide a method of polishing or grinding metal strips in the manner described which method is capable of polishing pinholes, pits or the like on their surface to be polished.

The term "polishing pinholes, pits or the like" and other similar terms used herein refer to polishing the pinholes, pits or the like such that the inside of the pinholes or the like is polished with a mixture of a grinding fluid or water with abrasive grains.

To achieve these and other objects, the present invention provides a method of polishing or grinding metal strips moving longitudinally of the strip, the method comprising brushing or polishing the metal strip using a brush roll which is rotatable and is held, during rotation, in contact with the strip surface pressed by the brush roll while supplying a mixture of a grinding fluid or water with abrasive grains to a portion of strip surface to be brushed or polished, said brush roll having a plurality of abrasive members selected from the group consisting of: (i) an abrasive member comprising a plurality of rod-shaped elastic supports and a plurality of abrasive tips, the abrasive tips being formed from a mixture of abrasive grains and a resin or from abrasive grains hardened with a resin binder, said abrasive tips being attached to the forward ends of the supports, and the plurality of said abrasive members being mounted in clusters on a roll shaft; (ii) an abrasive member comprising a bristle of filament yarns formed from a resin having incorporated therein abrasive grains, the plurality of said abrasive members being mounted in clusters on a roll shaft; and (iii) an abrasive member comprising a bristle of filament yarns formed from a resin, the plurality of said abrasive members being mounted in clusters on a roll shaft, wherein the strip surface is brushed by said brush roll under a pressure of at least 1 kg/cm$^2$ and wherein said abrasive members have elasticity commensurate with stiffness which permits the ends of abrasive members to contact with the strip during brushing under said pressure, and the abrasive members have forward ends of at least 2 mm in diameter.

DETAILED DESCRIPTION OF THE PREFERRED EMBODIMENTS

Figure 1:
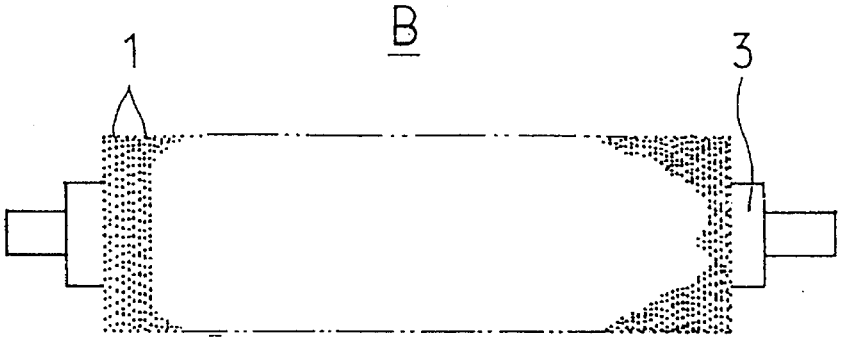
FIG. 1 is a front view schematically showing an example of the brush roll to be used in the present invention.

The present invention will be described below in greater detail with reference to the drawings showing embodiments of brush rolls and abrasive members for use in the present invention.

Throughout the drawings, like parts are designated by like reference numerals.

A brush roll B to be used for polishing a strip surface according to the invention is schematically shown in FIG. 1. An abrasive member 1 of the brush roll B has elasticity commensurate with stiffness which permits the end of abrasive member to contact with a metal strip P under a pressure during brushing in a manner to be described later, and the abrasive member 1 has a forward end of at least 2 mm in diameter.

The abrasive member 1 has novel features of showing elasticity corresponding to said specific stiffness and having a forward end of at least 2 mm in diameter. But abrasive members are known which are similar to the abrasive member 1 in the structure and components. Such known abrasive members are disclosed, for example, in U.S. Pat. No. 4,993,198 and Japanese Unexamined Patent Publication Hei 4-19,078. Also known are abrasive members different from those of the U.S. patent and Japanese publication, such as those which have, as a component element, filament yarns of a resin having incorporated therein abrasive grains and those which have, as a component element, filament yarns of a resin.

Figure 2:
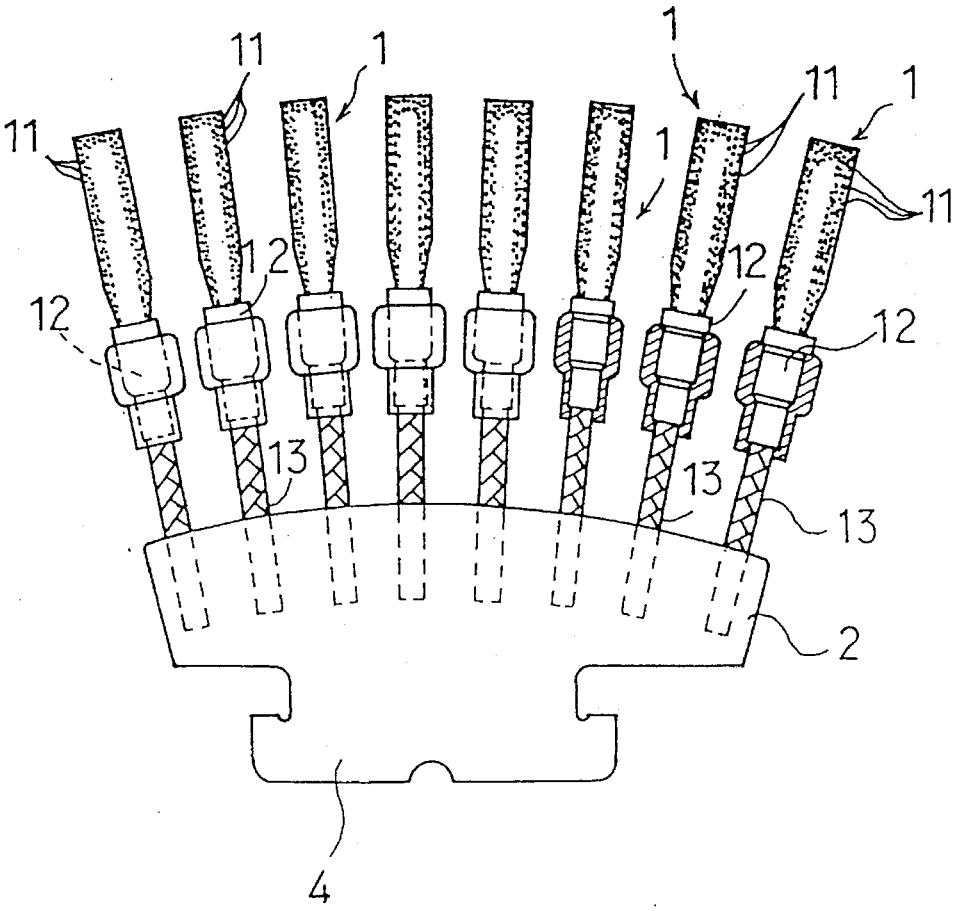
FIG. 2 is a front view showing, as an example of a brush roll element, a disk segment having the abrasive members of FIG. 7.
Figure 9:
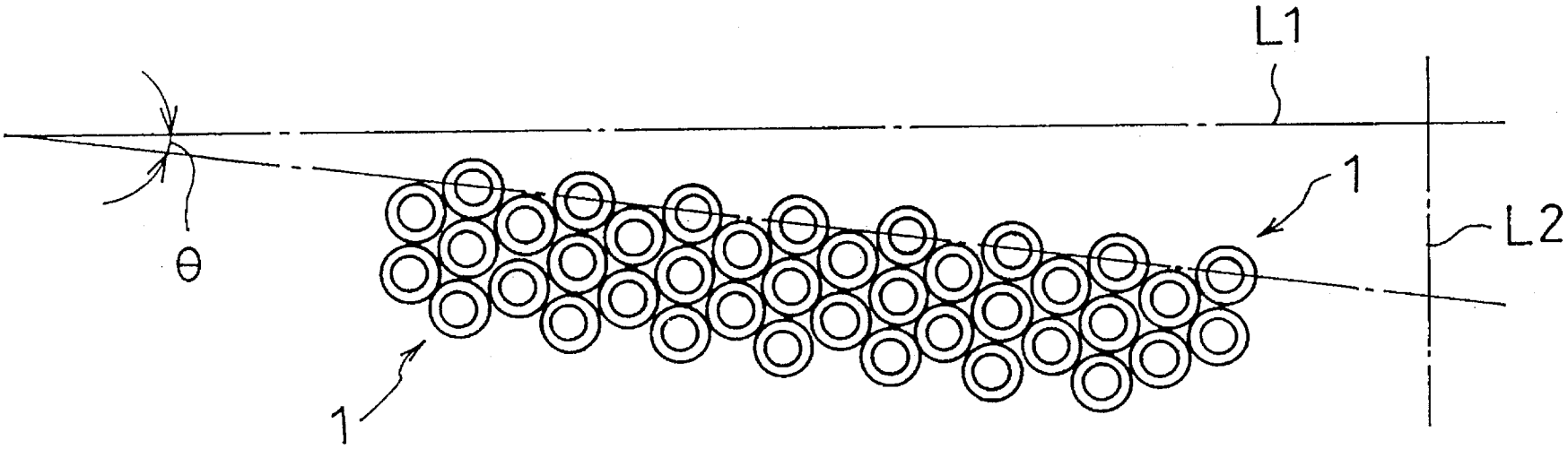
FIG. 9 is a plan view showing a preferred arrangement of abrasive members of the brush roll to be used in the invention, the abrasive members comprising rod-shaped elastic supports and abrasive tips, the abrasive tips being formed from a mixture of abrasive grains and a resin and attached to the forward ends of the supports, and said abrasive members showing elasticity commensurate with said specific stiffness and having forward ends of said specific diameter.
Figure 10:
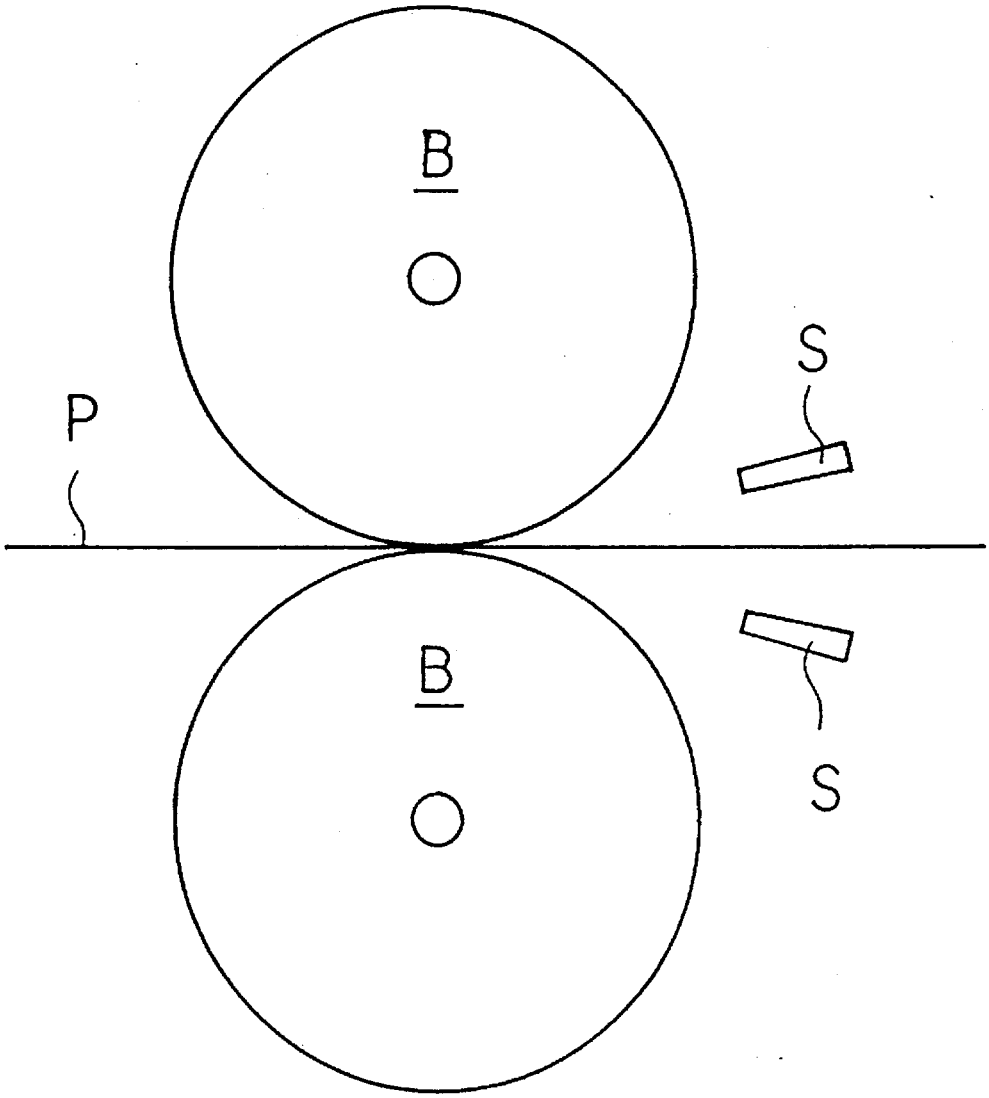
FIG. 10 is a side view showing a mode of supplying a mixture of a grinding fluid or water with abrasive grains, and indicating an example of the position of the two brush rolls.

The abrasive member 1 shown in FIG. 2 comprises small rod-shaped abrasive tips 11 composed of abrasive grains hardened with a resin binder and rod-shaped elastic supports 13 having the abrasive tips 11 attached to the forward ends thereof. The abrasive tips 11 are bonded to the ends of supports 13 on contraction of a metal sleeve 12 by press working. The supports 13 are produced by impregnating fiber braids with a resin. A plurality of abrasive members 1 are attached to the outer peripheral edge of a disk segment 2 of wedge-shaped board as aligned in the longitudinal direction of the disk segment 2. Disk segments 2 are circumferentially assembled on the peripheral surface of a roll shaft 3 around an axis thereof. The circular assemblies of the disk segments 2 are placed in contact with each other in the longitudinal direction of the roll shaft 3. The disk segments 2 are mounted circumferentially on the roll shaft 3 in such a manner that the abrasive members 1 are closely clustered together, for example, as shown in FIG. 9. In FIG. 9, the clusters of abrasive members are only partly shown. To mount the disk segments 2 on the roll shaft 3, the disk segment 2 has a key 4 substantially resembling a dovetail, and the key 4 is fitted into a key groove 5 formed in a shape substantially resembling a dovetail on the peripheral surface of the roll shaft 3.

Figure 5:
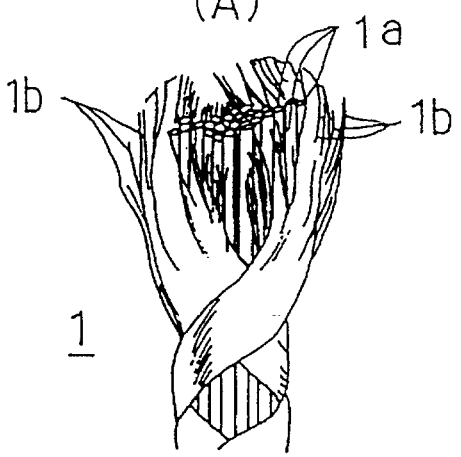
FIG. 5(A) is an enlarged perspective view showing an example of the bristle as the abrasive member.
FIG. 5(B) is an enlarged perspective view showing another example of the bristle as the abrasive member.
Figure 5:
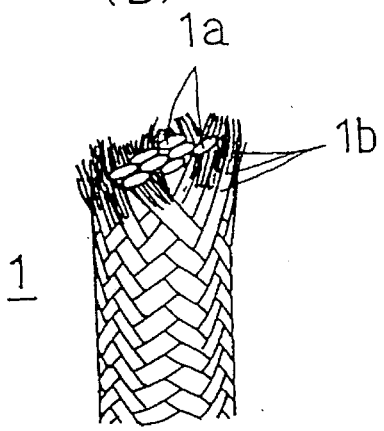

The abrasive member 1 illustrated in FIG. 5(A) can be a bristle comprising a bundle of filament yarns 1*a* made from a mixture of a resin and abrasive grains by a method of forming monofilaments, said filament yarns 1*a* being covered with multi-filament yarns 1*b* spirally wound thereon clockwise or anticlockwise, and impregnated with a resin. The abrasive member 1 also has a forward end which is at least 2 mm in diameter and has an elasticity commensurate with a stiffness sufficient to allow the forward end to remain in contact with the metal strip P when the brush roll B is brushed against it under pressure of at least 1 kg/cm$^2$.

The abrasive member 1 illustrated in FIG. 5(B) is substantially the same bristle as that of FIG. 5(A) except that the filament yarns 1*a* of FIG. 5(B) are covered with a braid weave of the multi-filament yarns 1*b*.

In FIGS. 5(A), (B), the abrasive members 1 are depicted on a considerably enlarged scale for a better understanding of the covering of the filament yarns 1*a*.

Figure 6:
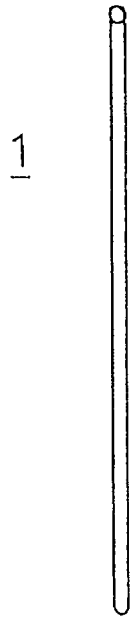
FIG. 6 is an enlarged perspective view showing a further example of the bristle as the abrasive member.
Figure 7:
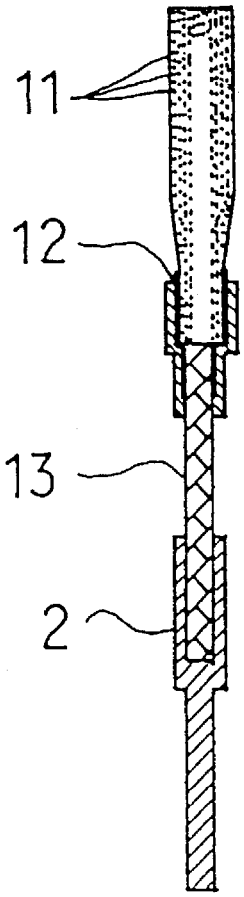
FIG. 7 is a side view showing the disk segment of FIG. 2 in longitudinal section.
Figure 8:
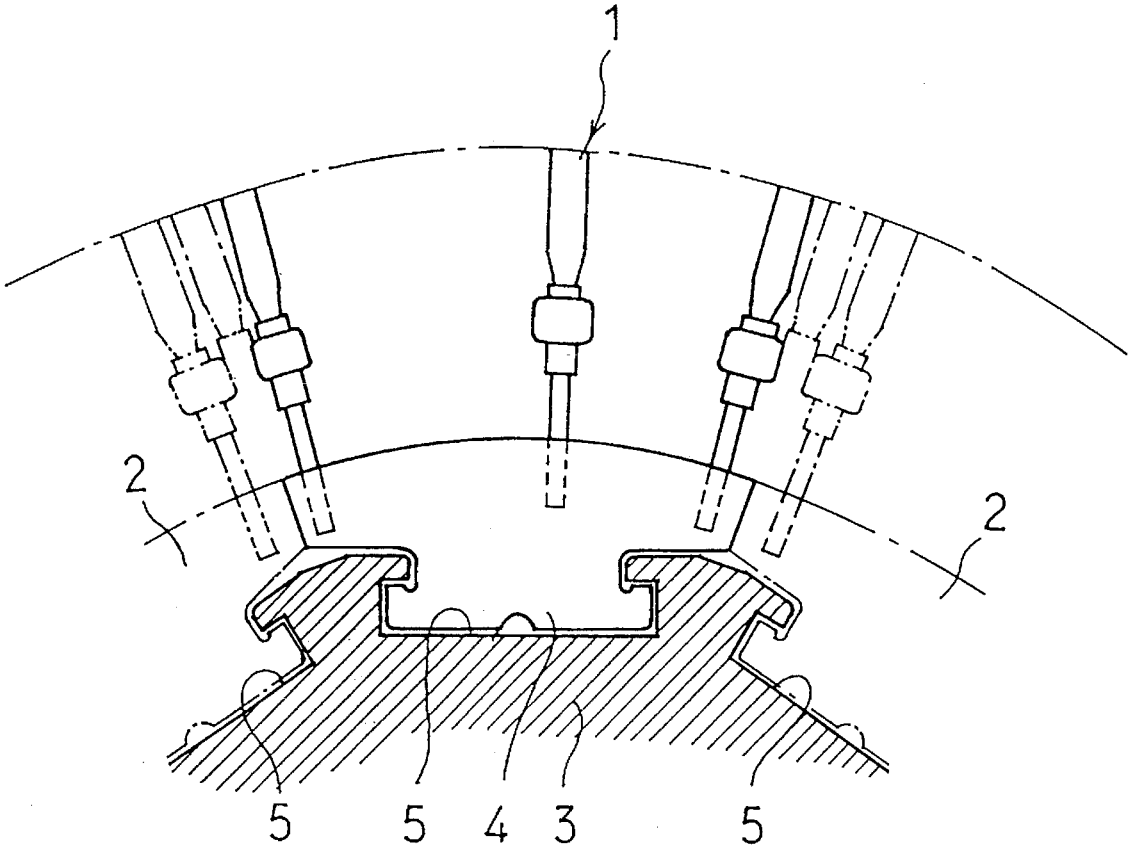
FIG. 8 is a section view showing a roll shaft into which the disk segment of FIG. 2 is being fitted.

The abrasive member 1 of FIG. 6 is a bristle comprising filament yarns of a synthetic resin such as nylon 612.

Figure 3:
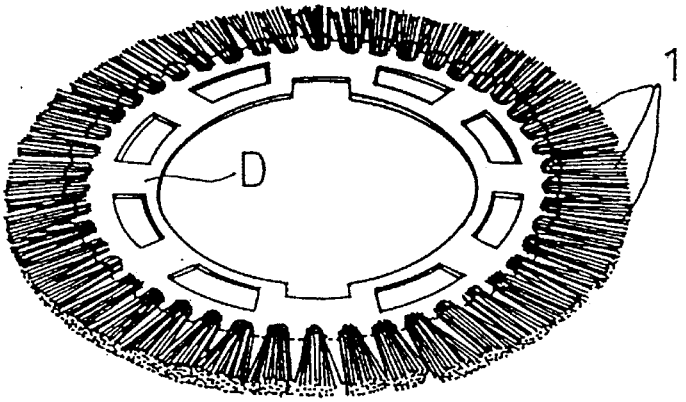
FIG. 3 PRIOR ART
FIG. 3 is a perspective view showing, as an example of a brush roll element, a disk with the bristles of FIGS. 5(A), 5(B) or 6 implanted therein.
Figure 4:
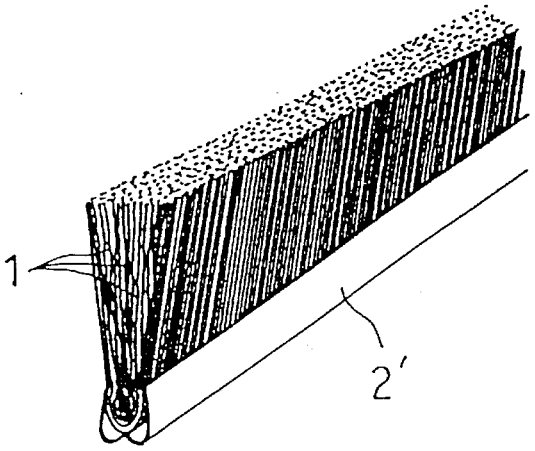
FIG. 4 PRIOR ART
FIG. 4 is a perspective view showing, as another example of a brush roll element, a member with the bristles of FIGS. 5 (A), 5(B) or 6 implanted therein.

The bristles of FIGS. 5(A), 5(B) and 6 are used as abrasive members, for example, in the following manner. The bristles are cut to the desired length and are implanted in clusters by the conventional method into an annular brush disk d (FIG. 3). The disk d having the bristles thus implanted is fitted in the conventional manner around the roll shaft 3, whereby the bristles used as the abrasive members 1 are mounted in clusters on the shaft 3. The type of disk d with the bristles implanted which is shown in FIG. 3 is widely known as a brush roll element in the art and thus it is only schematically sketched in FIG. 3. Optionally the bristles cut to the desired length may be implanted in the conventional manner into a groove-shaped support 2' made of a metal plate (FIG. 4) and the support 2' may be spirally wound in the conventional manner on the roll shaft 3 to mount thereon the bristles as the abrasive members 1 in clusters. The type of support with the bristles implanted which is shown in FIG. 4 is well known as a brush roll element in the art and thus it is only schematically sketched in FIG. 4.

According to the present invention, the brush roll B is rotated and the surface of strip P running longitudinally thereof is brushed or polished in contact with the brush roll under a pressure of at least 1 kg/cm$^2$ while a mixture of a grinding fluid or water with abrasive grains (hereinafter a fluid/abrasive grain mixture) is supplied to a portion of strip P to be brushed or polished with the brush roll B. The mixture may be supplied, for example, by spraying through a spray nozzle S. Grinding fluids to be incorporated into said fluid/abrasive grain mixture include those heretofore known in the fields of grinding steel strips and polishing other materials, such as an aqueous solution containing a machine oil, polyhydric alcohol or like surfactant and chlorinated paraffin.

In accordance with the invention, it is essential that the abrasive members clustered on the roll shaft be those having forward ends of specific diameter and showing elasticity corresponding to said specific stiffness to provide the brush roll which can brush or polish the surface of a metal strip with the aid of the fluid/abrasive grain mixture. Said brush roll is adapted to press the strip surface under a load of at least 1 kg/cm$^2$ and can operate in a manner to not only follow the projections and indents but also polish pinholes, pits and the like on the strip surface to be brushed or polished. The reason for this function remains to be clarified but is presumably as follows.

Since the abrasive members of the invention have elasticity commensurate with stiffness enabling their ends to contact with the strip surface during brushing under the specific pressure, the ends, not the side portions, of the abrasive members are allowed to brush or polish the strip surface as if spring-loaded. From another viewpoint, the brush roll of the invention is an assembly of abrasive members which are infinitesimally fractionized modifications of abrasive surfaces provided in conventional rotary polishing machines, such as abrasive disks, abrasive belts, etc. This means that even the individual abrasive members tend to capture, at their ends, the fluid/abrasive grain mixture fed to the strip surface to be polished. In this case, the abrasive grains of the mixture captured by the end face of the abrasive member are likely to be caught by or lodged in the resin of the mixture on the end face of abrasive members. Due to these factors, coupled with other factors, it becomes possible to make effective use of the fluid/abrasive grain mixture captured by the abrasive members held in contact with the strip surface under a pressure and the brush roll is permitted to polish the defective spots on the strip surface. The other factors include the function of individual abrasive members to operate at their tips in a spring-loaded manner, the feature of abrasive members having forward ends of specific diameter and the capability of holding the fluid/abrasive grain mixture by the interstices between the abrasive members. The defective spots of metal strip can be polished by virtually the same degree of brushing as on a flawless strip surface. The abrasive members can follow the projections and indents on the metal strip because the abrasive members operate in a spring-loaded manner.

According to the invention, the best result can be obtained by the brush roll which comprises abrasive members including rod-shaped elastic supports and abrasive tips, said tips being attached to the forward ends of the supports, said abrasive members having forward ends of specific diameter and showing elasticity commensurate with stiffness sufficient to permit the abrasive member ends to contact with the strip surface during brushing under the specific pressure.

If the abrasive members of such brush roll are mounted on the roll shaft 3 in a zigzag arrangement as a whole and extend spirally on the peripheral surface of the shaft 3 at an acute angle of torsion θ in the longitudinal direction thereof (FIG. 9), said polishing effect is increased. According to this arrangement of abrasive members, a strip surface is polished by rows of abrasive members such that each row is aligned in the circumferential direction with the abrasive members of each row displaced from each other according to said torsion angle θ relative to the longitudinal direction of the shaft 3. In other words, the rows of abrasive members mounted circumferentially on the shaft 3, as a whole, can polish a wider area of strip surface. As a result, the abrasive members arranged zigzag are more likely to polish an increased number of defective spots of strip surface. When disk segments 2 with abrasive members implanted are mounted on the roll shaft 3 by a key-key groove joint, the disk segments 2 with the abrasive members arranged zigzag can be mounted as follows. Key grooves 5 are formed to extend spirally on the peripheral surface of the shaft 3 as displaced from each other at the desired torsion angle in the longitudinal direction thereof. For this purpose, it is suitable that the torsion angle θ be in the range of about 1° to about 10° C.

In FIG. 9, L1 represents a line in parallel with the axis of the shaft 3 and L2 designates a line vertical to the line L1, namely a line in parallel with the rotating direction of the brush roll B.

What we claim is:

1. A method of polishing or grinding metal strips comprising the steps of:

rotating a rotatable brush roll comprising a plurality of abrasive members mounted in clusters on a shaft of said brush roll, each of said abrasive members comprising a plurality of rod-shaped elastic supports and a plurality of abrasive tips mounted on forward ends of said supports, the abrasive tips comprising a mixture of abrasive grains and a resin, forward ends of said abrasive tips having a diameter of at least 2 millimeters;

bringing a surface of a metal strip into contact with said rotating brush roll;

brushing said metal strip surface with said rotating brush roll under a pressure of at least 1 kg/cm$^2$, said abrasive members having an elasticity commensurate with a stiffness sufficient to allow said forward ends of said abrasive tips to remain in contact with said metal strip surface under said pressure; and supplying a mixture selected from the group consisting of grinding fluid and water with abrasive grains to said metal strip surface during said step of brushing.

2. A method of polishing or grinding metal strips comprising the steps of:

rotating a rotatable brush roll comprising a plurality of abrasive members, each of said abrasive members comprising a bristle of filament yarns comprising a resin having abrasive grains incorporated therein, said plurality of abrasive members being mounted in clusters on a shaft of said brush roll, forward ends of said abrasive members having a diameter of at least 2 millimeters;

bringing a surface of a metal strip into contact with said rotating brush roll;

brushing said metal strip surface with said rotating brush roll under a pressure of at least 1 kg/cm$^2$, said abrasive members having an elasticity commensurate with a stiffness sufficient to allow said forward ends of said abrasive members to remain in contact with said metal strip surface under said pressure; and supplying a mixture selected from the group consisting of grinding fluid and water with abrasive grains to said metal strip surface during said step of brushing.

3. A method of polishing or grinding metal strips comprising the steps of:

rotating a rotatable brush roll comprising a plurality of abrasive members, each of said abrasive members comprising a bristle of filament yarns comprising a resin, said plurality of abrasive members being mounted in clusters on a shaft of said brush roll, forward ends of said abrasive members having a diameter of at least 2 millimeters;

bringing a surface of a metal strip into contact with said rotating brush roll;

brushing said metal strip surface with said rotating brush roll under a pressure of at least 1 kg/cm$^2$, said abrasive members having an elasticity commensurate with a stiffness sufficient to allow said forward ends of said abrasive members to remain in contact with said metal strip surface under said pressure; and supplying a mixture selected from the group consisting of grinding fluid and water with abrasive grains to said metal strip surface during said step of brushing.

* * * * *